United States Patent [19]

Itami et al.

[11] Patent Number: 4,801,341

[45] Date of Patent: Jan. 31, 1989

[54] ONE-SIDED ENAMELABLE HOT-ROLLED STEEL SHEET AND PROCESS FOR PRODUCING THE SAME

[75] Inventors: Atsushi Itami; Kazuo Koyama; Nobuhiko Matsuzu; Takahito Watanabe, all of Kimitsu, Japan

[73] Assignee: Nippon Steel Corporation, Tokyo, Japan

[21] Appl. No.: 79,805

[22] Filed: Jul. 31, 1987

[30] Foreign Application Priority Data

Aug. 6, 1986 [JP] Japan ..... 61-183426

[51] Int. Cl.[4] ..... C22C 38/06; C21B 7/13

[52] U.S. Cl. ..... 148/320; 148/12 C

[58] Field of Search ..... 148/320, 12 C; 420/87, 420/128

[56] References Cited

U.S. PATENT DOCUMENTS 3,677,834 7/1972 Mayer et al. ..... 148/320

FOREIGN PATENT DOCUMENTS 54-71717 6/1979 Japan ..... 148/320
60-221520 11/1985 Japan .
1222466 2/1971 United Kingdom .
1464232 2/1977 United Kingdom .

*Primary Examiner*—Deborah Yee
*Attorney, Agent, or Firm*—Wenderoth, Lind & Ponack

[57] ABSTRACT

A hot-rolled steel sheet suitable for enamelling on one side is disclosed. The steel consists essentially of 0.0050–0.07 wt % C, 0.05–1.5 wt % Mn, 0.03 0.15 wt % P, 0.03–0.1 wt % Al, 0.003–0.010 wt % N, provided that the N content is the sum of at least 0.002 wt % of free nitrogen not bound to Al and the content of nitrogen in other states, the nitrogen content as defined above satisfying the condition of $Al/N \geqq 10$ on the basis of weight percents and the balance being Fe and incidental impurities.

7 Claims, No Drawings

ONE-SIDED ENAMELABLE HOT-ROLLED STEEL SHEET AND PROCESS FOR PRODUCING THE SAME

FIELD OF THE INVENTION

The present invention relates to a hot-rolled sheet material suitable for enamelling on one side made from a continuously cast steel, and to a process for producing such a sheet steel.

Hot-rolled steel sheets that are primarily intended to be used in combustors such as water heaters and boilers and that are enamelled on one side are required to have resistance to blistering, copperhead formation and warping. In addition, a certain amount of strength is required for most of these steel sheets in the finished state used in these enamelled products.

The common steel sheets suitable for enamelling on two sides are required to have resistance to fish scale formation. Fish scale is a phenomenon in which water in the steel during firing to form hydrogen gas, which aggregates at the interface between the applied and fired enamel coat and the steel sheet after the enamel coat is fired, and which disrupts some areas of the fired enamel coat so that it will spall in the form of fish scale. In the case of the steel sheets suitable for enamelling on one side which are contemplated by the present invention, fish scale is not a problem since hydrogen gas can escape from the steel sheet on the side which is not to be enamelled.

One-sided enamelable hot rolled steel sheets are often used as the material of comparatively large and heavy vessels and hence are required to possess a certain amount of strength. However, the enamelling process involves a heat treatment at temperatures of 800° C. and higher and a decrease in the strength of the base metal is inevitable. This means that the strength of one-side enamelled hot rolled steel sheets to which the heat treatment in the enamelling process has been subjected cannot be ensured by simply increasing the strength of the parent steel sheets, and it has been difficult to reduce a drop in strength during or after the heat treatment in the enamelling process by conventional continuous-cast steels. Under these circumstances, nitrogen-bearing ingot-cast steels that have comparatively high carbon contents have been used as the starting material from which enamelled steel sheets are made. Since ingot-cast steels have rimmed-layers and are decarburized at the surface, they are free from the problems of blistering and copperhead formation and are suitable for use as materials for enamelling steel sheets. Notwithstanding this advantage, ingot casting is neither economical nor effective in view of the current rapid increase in the number of continuous casting mills.

The present inventors previously proposed in Japanese Laid-Open Patent Publication No. 60-221520 a process for producing one-sided enamelable hot-rolled sheet material which, by subjecting a continuously-cast steel having a specified composition to heat treatments conducted under specified conditions, would ensure that the resultnng steel will have good response to enamelling while undergoing no substantial decrease in strength. This technique was adaptable to applications of enamelled steel sheets such as in boilers and water heaters, and thereby satisfied to some extent the requirements of users. However, this technique had certain conditions where excessively high temperatures occurred during the firing of bases were used as materials of comparatively small vessels and if parts thereof were subjected to a strong working, grains in the parts were made coarse in the final this technique resulted in a drop in its strength.

SUMMARY OF THE INVENTION

An object, therefore, of the present invention is to provide a one-sided enamelable hot rolled steel sheet from a continuously cast slab that has good responsiveness to enamelling and which yet is free from the aforementioned problem of decrease in strength due to formation of coarse grains.

Another object of the present invention is to provide a process for producing such one-sided enamelable hot-rolled steel sheet.

The essence of the present invention is summarized below.

(1) A one-sided enamelable hot-rolled steel sheet that consists essentially of 0.0050–0.07 wt % C., 0.05–1.5 wt % Mn, 0.03 –0.15 wt % P, 0.03–0.1 wt % Al, 0.003–0.010 wt % N, at least 0.002 wt % of free nitrogen not bound to Al, the nitrogen content as defined above satisfying the condition of $Al/N \geqq 10$ on the basis of weight percents, and the balance being Fe and incidental impurities.

The term "N" (i.e. nitrogen) means the total nitrogen or all kinds of nitrogens that are contained in the steel sheet whereas the term "free nitrogen" means the nitrogen which is not in such a state that it has combined with any element such as aluminum in the steel sheet.

(2) A one-sided enamelable hot-rolled steel sheet as defined in (1) wherein the content of free N unbound to Al is in the range of from 0.002 wt % to 0.010 wt %, sum of N (wt %) as nitride and free N (wt %) is no less than 10.

(3) A process for producing a one-sided enamelable hot-rolled steel sheet consisting of the steps of:

(a) heating to at least 1,200° C. a continuously cast slab containing AlN in precipitated form which consists essentially of 0.0050–0.07 wt % C., 0.05–1.5 wt % Mn, 0.03 0.15 wt % P, 0.03–0.1 wt % Al, and 0.003–0.010 wt % N, provided that Al (wt %)/N (wt %) ° 10, and the balance being Fe and incidental impurities;

(b) hot-rolling the heated slab to produce a steel sheet; and (c) coiling the resultant steel sheet at a temperature that is at least 400° C. and which is not higher than the temperature determined by the following formula:

$$\left(625 + 50 \times \log\left(\frac{0.72 \times N}{Al}\right)\right)°C.$$

where log is the common logarithm and both N and Al are in weight percent.

(4) A process for producing a one-sided enamelable hot-rolled steel sheet which consists essentially of the steps of:

(a) hot-rolling a continuously cast slab containing AlN in unprecipitated form, which slab consists essentially of: 0.0050–0.07 weight percent C., 0.05–1.5 wt % Mn, 0.03–0.15 wt % P, 0.03–0.1 wt % Al, and 0.003–0.010 wt % N, provided that Al (wt %)/N (wt %) $\geqq 10$, and the balance being Fe and incidental impurities; and (b) coiling the resultant steel sheet at a temperature that is at least 400° C. and which is not higher than the temperature determined by the following formula:

$$\left(625 + 50 \times \log\left\{\frac{0.72 \times N}{Al}\right\}\right)°C.$$

where log is the common logarithm and both N and Al are in weight percent.

DETAILED DESCRIPTION OF THE INVENTION

The criticality of each of the components in the one-sided enamelable hot-rolled steel sheet of the present invention and that of their compositional ranges are described below.

Carbon is an element that has the important influence on the workability of the enamelling steel sheet and phenomena such as warping, blistering and copperhead formation. Blistering is a phenomenon in which the carbon in the steel sheet reacts during the enamel coat-firing step with the oxygen in the enamel or the firing atmosphere so as to cause gasous components such as CO and $CO_2$ to evolve. Copperhead is a defect that is caused by the formation of iron oxides due to large bubbles occurring ont the surface of the base steel and is harmful not only to the appearance of the enamelled product but also to its corrosion resistance.

As will be understood from the above, carbon is a factor that bears great significance in the development of defects occurring in the enamelled product. In one-sided enamelable hot-rolled steel sheets where fish scale is not a problem, copperhead is the most damaging defect occurring in enamelled products. In order to produce enamelled steel sheets intended for use in water heaters and boilers, the enamel having hot water-resistant is employed but this enamel is highly likely to cause copperhead.

The present inventors conducted intensive studies in order to prevent the occurrence of copperheads and provide a desired result with a coat of enamel having hot water-resistant being once applied. As a consequence, the present inventors have found that if a special enamel containing Co (cobalt) content more than in a regular enamel is to be used, the occurrence of copperheads can be prevented by controlling the carbon content of the steel so as not to exceed 0.07 wt %.

The present inventors have also found that if one wants to attain desired results with a coat of the regular enamel being once applied, the carbon content must be controlled to be no more than 0.025 wt %.

If the upper limit of the carbon content in the steel is 0.07 wt % or below, a desired, fired enamel coat can be formed without causing copperhead and any other defects such as blistering and warping in the enamelled product. Since a minimum level of strength must be ensured, the lower limit of carbon content in the steel is set at 0.0050 wt %. A preferred range of carbon content is between 0.008 and 0.020 wt % if the regular enamel is used, and it is between 0.008 and 0.050 wt % if the special enamel is used.

Manganese is necessary as an auxiliary strengthening element. The absolute strength of the enamelled steel sheet in the finished state is ensured principally by P, and Mn and C both serve as auxiliary strengthening elements. In order to accomplish enamelling without causing any deleterious effects such as warping and to ensure that no difficulty is encountered in melting the steel in a steel-making process, the upper limit of Mn content is set at 1.5 wt %. The lower limit of Mn content is set at 0.05 wt % for the purpose of preventing hot-brittleness due to S.

Phosphorus is the principal strengthening element used to afford the absolute strength of the enamelled steel sheet in the finished state. Phosphorus is also effective as a component to be incorporated in an enamelling steel sheet for providing ease of scale removal. The upper limit of P content is 0.15 wt %, beyond which the steel remarkably becomes brittle. The lower limit of P content is set at 0.03 wt % for providing ease of descaling.

The condition in which aluminum and nitrogen exist in the steel and their contents are the most important factors for the purposes of the present invention. One function of aluminum is deoxidation, so it must be present in an amount of at least 0.03 wt %. Using aluminum as a deoxidizer does not constitute an important aspect of the present invention, in which aluminum is incorporated for the principal purpose of ensuring that it will be bound to free N in the steel during the enamel coat-firing step to form AlN. In order to attain this effect by providing as many sites as possible where aluminum binds with free N, the condition that $Al/N \geqq 10$ (where N is the total nitrogen containing N as nitrides and free N) must be satisfied. The upper limit for the conent of Al is set at 0.1 wt % in order that Al-derived inclusions such as $Al_2O_3$ will not cause any deleterious effects on the surface properties of the steel sheet or its workability.

As will be understood from the foregoing explanation, N as well as Al are important elements for the purposes of the present invention. Firing the enamel coat on a steel plate is a special heat treatment in that it is per se but for bonding the enamel to the steel both physically and chemically. As a result of the firing step, grains in ordinary steels grow in size to cause a drop in their strength. Water heaters, hot water supply systems and boilers are pressurized during use, so the enamelled steel sheets of which they are made must have a strength great enough to withstand such high pressures. research to provide a method for preventing the growth of grains during the enamel coat-firing. As a consequences, it was found that producing a precipitate in the steel during the enamel coat-firing is important for preventing the growth of grains and that AlN is the only precipitate such as Ti, Nb and B that form stable precipitates is adverse to the purposes of the present invention and such elements should not be present in one-sided enamelable hot-rolled steel sheets of the present invention. These elements have already formed stable precipitates at the stage of hot rolling, and in the subsequent enamel coat-firing step the precipitates will simply grow in size and are unable to prevent the movement of grain boundaries. On the other hand, AlN is not thermodynamically a precipitate that is as stable as Ti, Nb and B and this is the only compound that will not precipitate during the steel manufacturing process but which can be precipitated in the subsequent enamel coat-firing step.

For the reasons stated above, N must be incorporated in the steel and in this case, free N is the most important. The grains in the base steel sheet will grow during the enamel coat-firing unless it contains free N in a minimum amount of at least 0.002 wt %. Therefore, the total content of N including free N in the steel before enamel application and firing must be at least 0.003 wt %. In steelmaking operations, if N is supplied in excessive amounts, excess N will produce fumes that will either foul the environment or cause adverse effects on the health of operators. Therefore, in order to avoid the occurrence of such environmental problems during melting operations, the upper limit of N is set at 0.010 wt %.

Having discussed the criticality of the compositional range of each of the components in the one-sided enamelable hot-rolled steel sheet, we now describe the conditions to be employed in performing hot rolling to produce such a sheet.

A continuous-cast slab having a high temperature is preferably fed into the rolling mill directly in the ascast condition if AlN has not precipitated during the casting. Otherwise, the slab must be heated to 1,200° C. and above so as to form a solid solution compound of AlN. If the heating temperature is less than 1,200° C., AlN will precipitate in the hot-rolled product and the advantages of the present invention cannot be attained. The upper limit of the temperature at which the slab is heated is not specified but based on practical considerations, 1,300° C. would be a preferable upper limit.

In order to ensure that AlN will not precipitate during hot rolling, the temperature at which the hot-rolled steel is coiled must be specified. To achieve this end, as well as to ensure consistent production, the lower limit of the coiling temperature is set at 400° C. The upper limit depends on the contents of Al and total N and should satisfy the following formula:

$$\left(625 + 50 \times \log\left\{\frac{0.72 \times N}{Al}\right\}\right)°C.$$

where log is the common logarithm and Al and N are both in wt %.

The steel emerging from the last rolling stand is cooled on the runout table as it is taken up by the coiler. For maintaining N and Al in the rolled steel in better condition, the cooling pattern is preferably such that quenching in the first half of the cooling zone is done more rapidly than in the second half.

Other operations on the hot strip mill may be performed by normal procedures, and the finishing operations after coiling may be also done by the conventional procedures.

EXAMPLE

Liquid steels having the compositions shown in Table 1 were continuously cast into slabs.

TABLE 1

| Steel | C | Mn | P | Al | N | Classification |
|---|---|---|---|---|---|---|
| I | 0.067 | 0.17 | 0.054 | 0.05 | 0.0042 | Within the scope of the invention |
| II | 0.042 | 0.25 | 0.073 | 0.04 | 0.0037 | Within the scope of the invention |
| III | 0.021 | 0.29 | 0.091 | 0.06 | 0.0049 | Within the scope of the invention |
| IV | 0.013 | 1.30 | 0.079 | 0.05 | 0.0032 | Within the scope of the invention |
| V | 0.008 | 0.54 | 0.131 | 0.05 | 0.0043 | Within the scope of the invention |
| VI | 0.108 | 0.32 | 0.049 | 0.06 | 0.0039 | comparison |
| VII | 0.043 | 0.29 | 0.071 | 0.02 | 0.0049 | comparison |
| VIII | 0.041 | 0.27 | 0.070 | 0.07 | 0.0016 | comparison |

The slabs were heated at the temperatures indicated in Table 2, hot rolled at a finishing temperature of products having 2.5 mm thick were coiled at 500° C.

In Table 2, measurements of the content of free nitrogen, yield point (YP), tensile strength (TS) and elongation (El) were conducted on the resultant as-hot rolled sheets, and measurements of yield point, tensile strength and elongation were also conducted on the sheets that had been subjected to a heat treatment equivalent to enamel coat-firing, and the results are shown in Table 2. A regular enamel and a special Co-containing enamel were applied to each of the steel sheets and the quality of the fired enamel coat was evaluated. The results are also shown in Table 2. Nos. I-1 to VIII-1 in Table 2 correspond to Nos. I to VIII in Table 1, and No. II-2 in Table 2 corresponds to No. II in Table 1.

TABLE 2

| | | As hot rolled | | | | | After heat treatment equivalent to the enamel coating-firing | | | Enamel coat | |
|---|---|---|---|---|---|---|---|---|---|---|---|
| Classification | Sample No. | Heating temperature (°C.) | Free N (wt %) | YP (kgf/mm²) | TS (kgf/mm²) | El (%) | YP (kgf/mm²) | TS (kgf/mm²) | El (%) | Regular enamel | Special Co-containing enamel |
| Steels of the invention | I-1 | 1250 | 0.0039 | 35.1 | 44.2 | 33.1 | 34.9 | 43.9 | 33.2 | x | O |
| | II-1 | 1250 | 0.0033 | 31.0 | 43.1 | 33.2 | 30.9 | 42.7 | 36.4 | x | O |
| | III-1 | 1250 | 0.0045 | 35.1 | 44.8 | 31.0 | 36.0 | 45.7 | 30.1 | O | O |
| | IV-1 | 1250 | 0.0029 | 33.3 | 43.4 | 39.8 | 35.1 | 42.6 | 41.6 | O | O |
| | V-1 | 1250 | 0.0040 | 29.9 | 40.1 | 41.4 | 30.1 | 39.8 | 41.4 | O | O |
| Comparative steels | VI-1 | 1250 | 0.0032 | 38.4 | 46.9 | 29.8 | 35.1 | 42.8 | 30.9 | x | x |
| | VII-1 | 1250 | 0.0045 | 30.8 | 42.9 | 34.1 | 26.6 | 38.1 | 36.1 | x | O |
| | VIII-1 | 1250 | 0.0011 | 30.3 | 42.1 | 34.9 | 27.9 | 34.4 | 38.9 | x | O |
| | II-2 | 1100 | 0.0006 | 30.2 | 42.9 | 33.9 | 27.1 | 35.1 | 38.1 | x | O |

Note:
O, good;
x, copperheads formed.

As Table 2 shows, sample No. VI-1 having a high carbon content was very low in its responsiveness to enamelling. Sample Nos. VII-1 and VIII-1 were also outside the scope of the present invention in terms of Al and N contents, respectively, and experienced significant decreases in their strength properties after heat treatment equivalent to the enamel coat-firing. Sample No. II-2 which had been heated at an unduly low temperature (1,100° C.) had an unsatisfactory low level of free N production.

Sample Nos. II and VIII were subjected to a strong working (i.e. working of buckling such as hydrostatic bulging was effected but it was stopped immediately before each of the steel species was fractured) and then received a heat treatment equivalent to the enamel coat-firing. The resulting changes in their strength as a function of the coiling temperature are shown in Table .

TABLE 3

| Sample No. | Coiling temperature (°C.) | Steel No. II YP (kgf/mm²) | Steel No. II TS (kgf/mm²) | Steel No. II El (%) | Steel No. VIII YP (kgf/mm²) | Steel No. VIII TS (kgf/mm²) | Steel No. VIII El (%) |
|---|---|---|---|---|---|---|---|
| 2 | 700 | 24.9 | 40.2 | 40.0 | 22.7 | 31.0 | 41.3 |
| 3 | 600 | 25.5 | 41.0 | 37.1 | 23.8 | 33.2 | 40.7 |
| 4 | 550 | 30.8 | 43.0 | 35.8 | 24.1 | 33.2 | 39.2 |
| 1 | 500 | 31.1 | 43.2 | 35.1 | 24.3 | 33.8 | 39.1 |
| 5 | 450 | 32.1 | 44.1 | 34.7 | 25.2 | 34.2 | 38.2 |
| 6 | 400 | 32.5 | 45.3 | 34.0 | 25.9 | 35.1 | 37.8 |

As Table 3 shows, the strength of sample Nos. 2 and 3 of steel No. II was low because of the high coiling temperatures that were used. Steel No. VIII which did not have a good balance between Al and total N was unsuitable for the strong working under severe conditions.

As will be understood from the foregoing description, the one-sided enamelable hot-rolled steel sheet of the present invention is highly responsive to enamelling and yet undergoes no drop in strength as a result of the enamel coat-firing.

What is claimed is:

1. A one-sided enamelable hot-rolled steel sheet that consists essentially of 0.0050–0.07 wt % C., 0.05–1.5 wt % Mn, up to 0.03–0.15 wt % P, 0.03–0.1 wt % Al, 0.003–0.010 wt % N, at least 0.002 wt % of free nitrogen not bound to Al, the nitrogen content as defined above satisfying the condition of Al/N≧10 on the basis of impurities.

2. A one-sided enamelable hot-rolled steel sheet as defined in claim 1 wherein the content of free N unbound to Al is in the range of from 0.002 wt % to 0.010 wt %, provided that th weight percent of Al divided by the sum of N (wt %) as nitride and free N (wt %) is no less than 10.

3. A one-sided enamelable hot-rolled steel sheet as range of 0.008–0.025 wt %.

4. A one-sided enamelable hot-rolled steel sheet as defined in claim 1 or 2 wherein the C content is in the range of 0.008–0.050 wt %.

5. A process for producing a one-sided enamelable hot-rolled steel sheet consisting of the steps of:

(a) heating to at least 1,200° C. a continuous-cast slab that consists essentially of 0.0050–0.07 wt % C., 0.05–1.5 wt % Mn, 0.03–0.15 wt % P, 0.03–0.1 wt % Al, and 0.003–0.010 wt % N, provided that Al (wt %)/N (wt %) ≧10, and the balance being Fe and incidental impurities;

(b) hot-rolling- the heated slab to produce a steel sheet; and (c) coiling the resultant steel sheet at a temperature that is at least 400° C. and which is not higher than the temperature determined by the following formula:

$$\left(625 + 50 \times \log\left(\frac{0.72 \times N}{Al}\right)\right)°C.$$

where log is the common logarithm and both N and Al are in weight percent.

6. A process according to claim 5 wherein the C content is in the range of 0.008–0.025 wt %.

7. A process according to claim 5 wherein the C content is in the range of 0.008–0.050 wt %.

* * * * *

UNITED STATES PATENT AND TRADEMARK OFFICE

CERTIFICATE OF CORRECTION

PATENT NO. : 4,801,341

DATED : January 31, 1989

INVENTOR(S) : Atsushi ITAMI, Kazuo KOYAMA, Nobuhiko MATSUZU, and Takahito WATANABE

It is certified that error appears in the above-identified patent and that said Letters Patent is hereby corrected as shown below:

Claim 1, line 3, delete "up to";
, last line, before "impurities" insert --weight percents, and the balance being Fe and incidental--;

Claim 2, line 4, change "th" to --the--;

Claim 3, line 1, after "as" insert --defined in claim 1 or 2 wherein the C content is in the--;

Claim 5, line 9, change "hot-rolling- the" to --hot-rolling the--

Signed and Sealed this

Second Day of January, 1990

*Attest:*

JEFFREY M. SAMUELS

*Attesting Officer*

*Acting Commissioner of Patents and Trademarks*